US007100650B2

(12) United States Patent
Heiner et al.

(10) Patent No.: US 7,100,650 B2
(45) Date of Patent: Sep. 5, 2006

(54) VENEER SLICER

(75) Inventors: Armin Heiner, Hohenroda (DE); Jean Meyer, Friedewald (DE); Heinrich Weppler, Ludwigsau (DE)

(73) Assignee: Grenzebach-BSH GmbH, Hersfeld (DE)

( * ) Notice: Subject to any disclaimer, the term of this patent is extended or adjusted under 35 U.S.C. 154(b) by 0 days.

(21) Appl. No.: 10/535,546

(22) PCT Filed: Sep. 26, 2003

(86) PCT No.: PCT/EP03/10757

§ 371 (c)(1),
(2), (4) Date: May 18, 2005

(87) PCT Pub. No.: WO2004/094121

PCT Pub. Date: Nov. 4, 2004

(65) Prior Publication Data

US 2006/0124199 A1 Jun. 15, 2006

(30) Foreign Application Priority Data

Dec. 13, 2002 (DE) ..... 102 61 918

(51) Int. Cl.
*B27L 5/02* (2006.01)

(52) U.S. Cl. ..... 144/214; 144/215; 144/178; 144/245.3

(58) Field of Classification Search ..... 144/214, 144/215, 212, 209.1, 178, 245.3
See application file for complete search history.

(56) References Cited

U.S. PATENT DOCUMENTS

| | | | | |
|---|---|---|---|---|
| 793,306 | A * | 6/1905 | Koss | 144/178 |
| 3,176,735 | A * | 4/1965 | Pelto | 144/215.2 |
| 4,384,601 | A | 5/1983 | Richert | |
| 4,601,317 | A * | 7/1986 | Brand | 144/178 |

FOREIGN PATENT DOCUMENTS

| | | |
|---|---|---|
| DE | 30 26 162 | 9/1981 |
| EP | 386813 A2 * | 9/1990 |
| EP | 0 584 268 | 3/1994 |

* cited by examiner

*Primary Examiner*—Bena Miller
(74) *Attorney, Agent, or Firm*—Andrew Wilford

(57) ABSTRACT

The problem in previously known stay log-type veneer slicers in which a large block of wood is directed in an eccentrically rotating manner past a knife consists of the fact that a remaining block that cannot be sliced has to be removed by hand from a girder structure on which the block is mounted. Hence, the downtime for removing the remaining block and mounting a new block of wood is relatively long. The aim of the invention is therefore to create a stay log-type veneer slicer that has a reduced downtime. Said aim is achieved by disposing means for discarding the block of wood (16) and a device for automatically conveying away the discarded block of wood on the girder structure (12).

8 Claims, 3 Drawing Sheets

5
8
7
11
3
1
9
2
7
14
10
6
27
23
20
25
19
24
4
22
12
19
13
20
17
16
28
24
16

VENEER SLICER

CROSS REFERENCE TO RELATED APPLICATIONS

This application is the US national phase of PCT application PCT/EP2003/010757, filed 26 Sep. 2003, published 4 Nov. 2004 as WO 2004/094121, and claiming the priority of German patent application 10261918.2 itself filed 13 Dec. 2002.

The invention relates to an apparatus for the eccentric slicing of veneer from a flitch according to the introductory clause of claim 1.

Such an apparatus is used to cut thin sheets, also called veneers, from a wood flitch. The process is also called slicing. In it the flitch is secured to a planar support surface of a beam. It is rotatable about a horizontal axis so that with each revolution a veneer is cut off by a blade extending parallel to the rotation axis and movable toward the beam. Such an apparatus is also known as a stay-log veneer machine.

A tangential veneer-slicing machine is known from EP 0,584,268 that holds four flitches on a beam (flitch table). Clamp dogs with oval heads are used that are rotatable on the flitch table and that fit releasably in grooves cut in the flitch.

German 30 26 162 describes a similar stay-log veneer-slicing machine where dogs engage in grooves in the back face of the flitch to hold the flitch. In addition to these dogs, separate retaining claws engage laterally into the flitch. These claws can be swung out of the way when the flitch has been cut down to a predetermined size.

The known stay-log veneer-slicing machine has the problem that the flitch scrap, that is the piece of wood left after all the possible veneer has been sliced off, must be taken by hand off the beam. Thus the changeover time to remove the flitch scrap and secure a fresh flitch in place is relatively great.

It is an object of the invention so to improve a stay-log veneer-slicing machine that the changeover time to remove the flitch scrap and secure a fresh flitch in place is shortened.

This object is attained by the characterizing features of claim 1. Since means is provided on the log bar for knocking off the flitch and means is provided for automatically transporting away the knocked-off flitch, no time is wasted removing it. The service personnel do not need to bother with removing and transporting away the flitch scrap and are thus freed.

The time saving achieved by the apparatus according to the invention is 20 to 30 seconds. With an average cycle time (time from the end of the veneer slicing of a first flitch to the end of the veneer slicing of the subsequent flitch) of about five minutes with standard systems the relative time saving and the associated productivity increase is about 7 to 10%.

The dependent claims relate to preferred embodiments of the invention. Conveyor chains according to claim 2 are simple and robust. The recessed arrangement according to claim 3, that is recessed below a surface, protects the conveyor chains from damage by the falling flitch.

The invention is further described with reference to a schematically illustrated example shown in the drawing. Therein:

Figure 1:
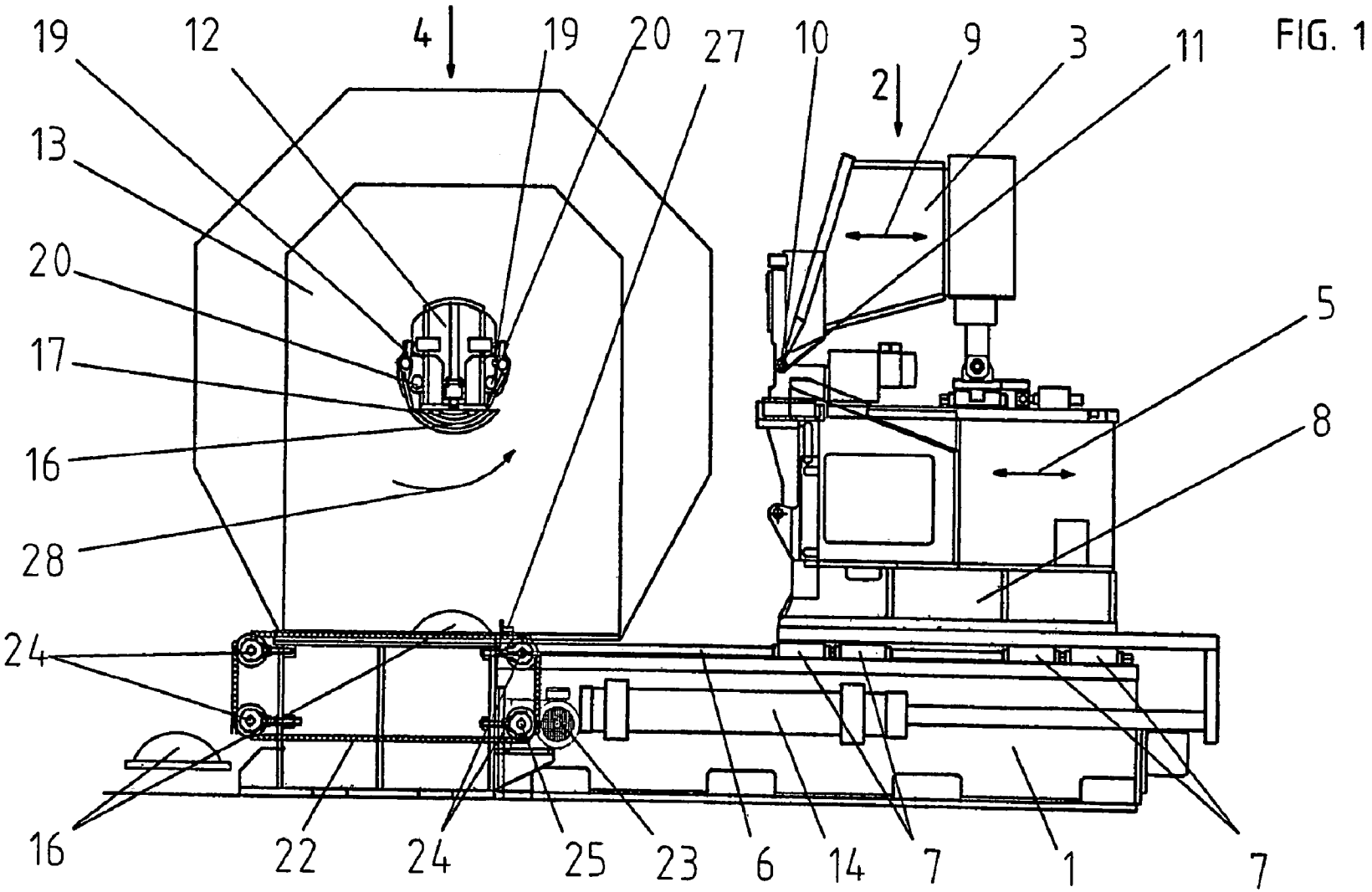
FIG. 1 is a side view of a stay-log veneer-slicing machine, partly in section.

As shown in FIG. 1 a veneer-slicing machine has a stationary frame 1 carrying along one side, here the right side, a tool slide 2 with a blade holder 3 and on the other side, here the left side, a stay-log beam 4.

The tool slide 2 is reciprocal in a horizontal plane on two parallel rails 6 as shown by arrow 5. To this end the tool slide 2 is shiftable by hydraulic cylinders 14 and mounted on guides 7 that are fixed to a machine frame 8 so they have minimal play and cannot twist on the rails 6.

An upper region of the machine frame 8 carries the blade holder 3 for a blade 10 that is shiftable in the direction of arrow 9 and that is pivotal about an axis at a lower cutting edge of the blade 10. The blade 10 and its cutting edge extend at a right angle to the movement direction of the tool slide 2. To this end the blade 10 is mounted on the side (left in FIG. 1) of the blade holder 3 that is closer to the stay-log beam 4. The pivotal and sliding movements of the blade holder 3 relative to the machine frame 8 necessary to adjust its position relative to a below-described pusher bar 11 are effected by various hydraulic cylinders.

Below and parallel to the blade 10, the machine frame 8 carries the pusher bar 11. The pusher bar 11 and the blade 10 are set such that in use they are slightly spaced from one another.

The machine frame 8 carries further unillustrated devices for carrying off the sliced veneer sheets.

The stay-log beam 4 is mounted on the frame 1 such that the horizontal longitudinal axis of its log bar 12 extends parallel to the cutting edge of the blade 10. The log bar 12 is rotatable between two housing walls 13 and connected to an unillustrated drive. A flitch 16 is clamped to a planar support face 15 of the log bar 12 by clamping means, here retaining dogs 17 and holding claws 19. The retaining dogs 17 project in two rows parallel to the longitudinal axis of the log bar 12 from the support face 15, the rows of retaining dogs 17 being movable toward and away from one another by unillustrated actuators. The retaining dogs 17 engage in grooves 18 that are cut in a back face of the flitch 16. The spacing of the dogs 17 and of the grooves 18 is the same.

In addition to the retaining dogs 17, both longitudinal edge regions of the log bar 12 that flank the support face 15 have the holding claws 19 that are mounted on first shafts 20 pivotal at each side so that they can be pressed by rotation about an axis parallel to the longitudinal axis of the log bar 12 into a work position against the flitch 16 or into a rest position against the sides of the log bar 12. Each first shaft 20 is connected to an unillustrated rotary drive. The holding claws 19 are not shown in FIG. 3 for clarity of view.

This far the veneer-slicing machine corresponds to the prior art.

The improvement according to the invention comprises means for knocking off the flitch 16 (the flitch scrap) after the veneer-slicing operation is completed and for automatically transporting it away.

Figure 2:
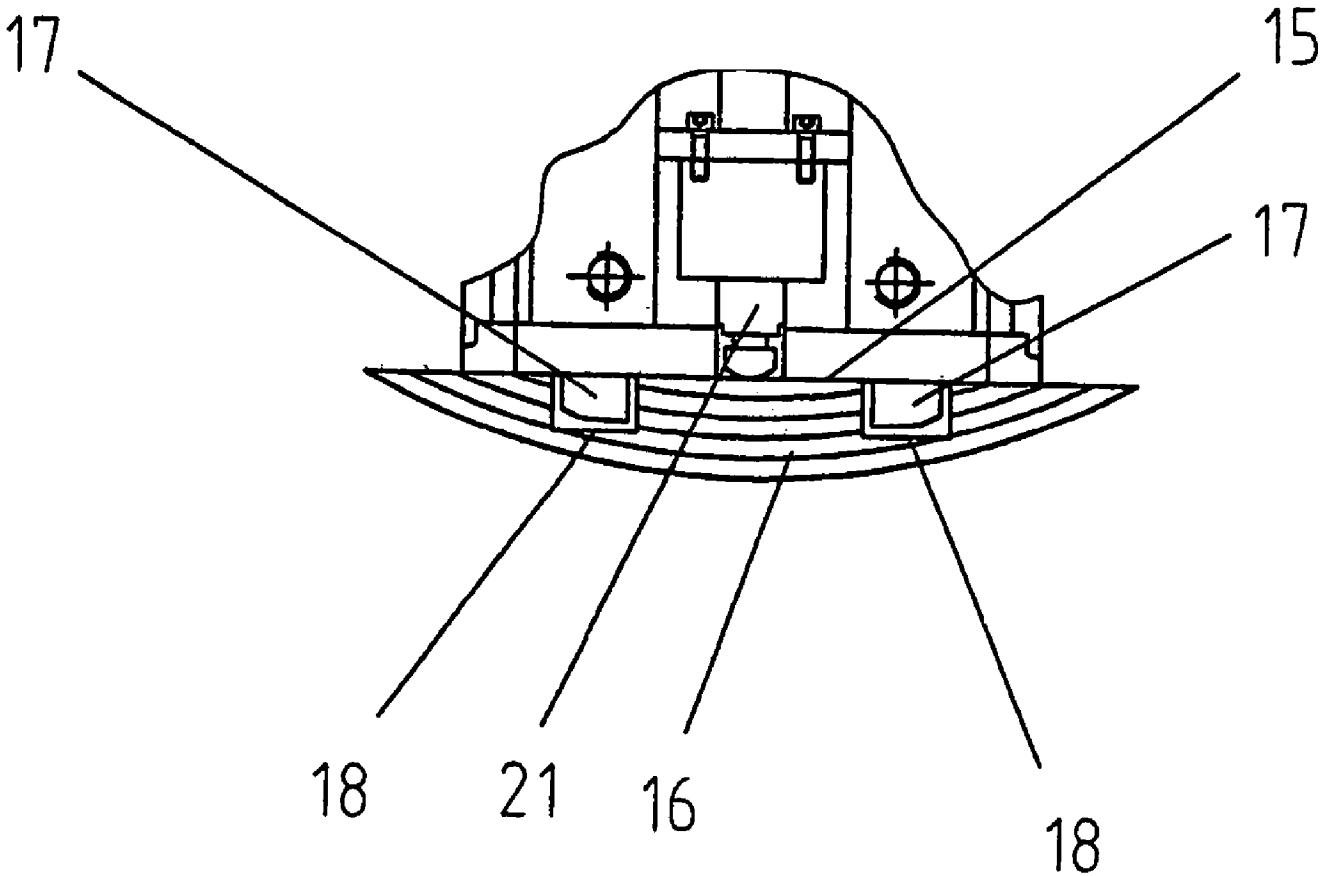
FIG. 2 is a detail view of a part of a stay-log beam of FIG. 1.
Figure 3:
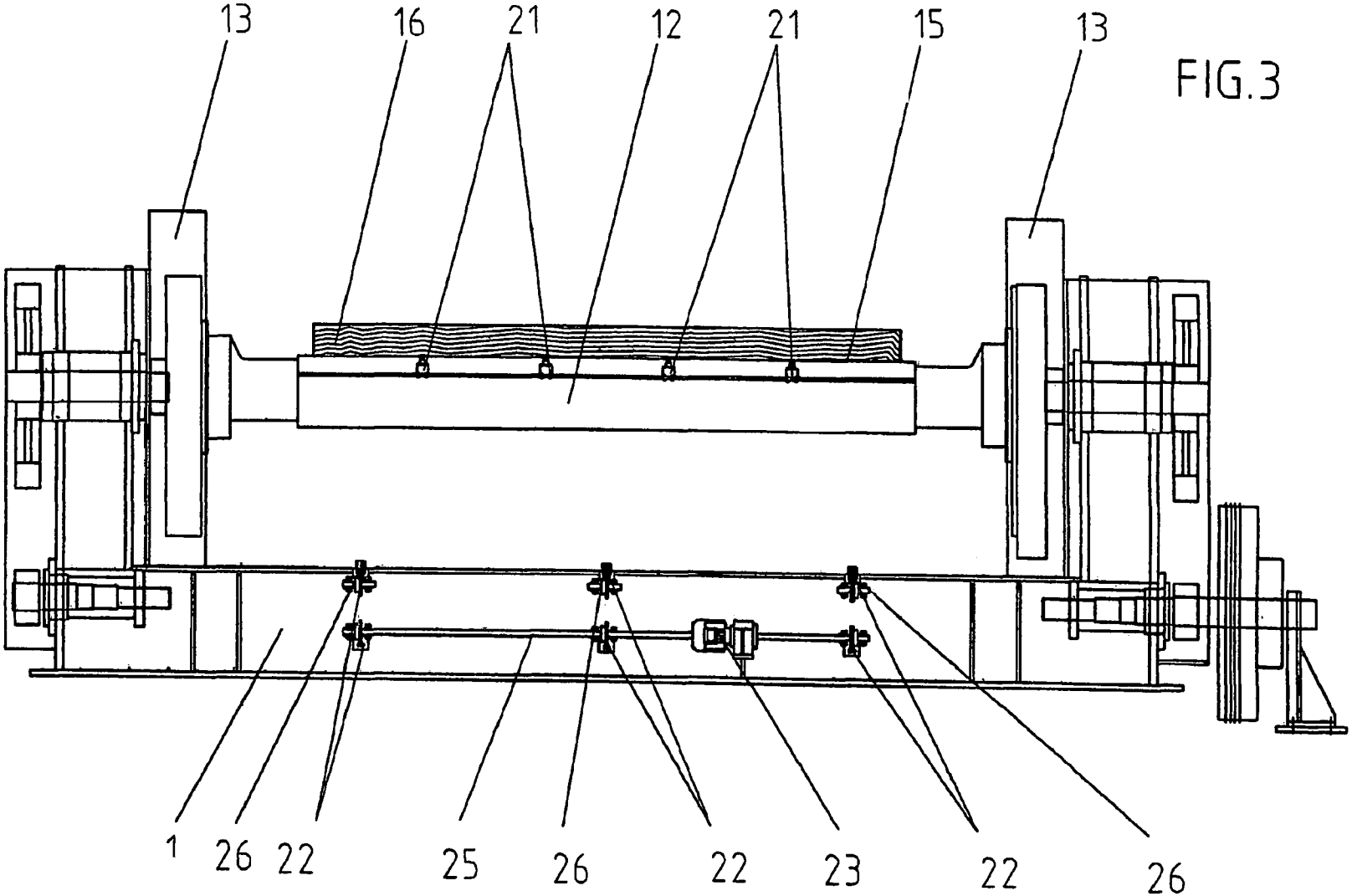
FIG. 3 is a view of the stay-log beam partly in section seen from the tool slide.

The knockoff means are best seen in FIGS. 2 and 3 and in this embodiment comprise four hydraulic cylinder actuators 21. They are uniformly spaced in the log bar 12 so that the outer ends of their pistons 21 are aligned with openings in the support face 15 and the longitudinal axes of the pistons 21 are substantially perpendicular to the face 15. In rest positions the ends of the pistons 21 are recessed in the log bar 12; in work positions the pistons 21 project through the respective openings of the face 15 of the log bar 12.

The system for automatically transporting away comprises three parallel endless conveyor chains 22, a drive with a motor 23, and sprocket wheels 24. Each conveyor chain 22 is spanned over four sprockets 24 of which one serves as a tightener and one is driven. The sprockets 24 are rotatable about axes in two vertically spaced horizontal planes, the drive sprockets being mounted on a shaft 25 driven by the drive motor 23. The sprockets 24 are mounted such that their rotation axes are parallel to the longitudinal axis of the log beam 12 and the chain reaches are planar and form a rectangle.

Six of the sprockets 24, which are arrayed in a vertical plane extending parallel to the longitudinal axis of the log beam 12, are spaced from this longitudinal axis toward the tool slide 2. The other six sprockets 24 are on the side of the frame 1 opposite the tool slide 2.

Each conveyor chain 22 is spanned over four sprockets 24 situated in a vertical plane extending perpendicular to the log beam 12 such that it forms a rectangle with rounded corners. Each conveyor chain 22 is recessed between the respective upper sprockets 24 in a U-section rail 26 so that its upper stretch is below a planar and horizontal surface formed by plates of the base frame 1.

The conveyor chains 22 are uniformly spaced with the middle one generally central underneath the log bar 12.

Each conveyor chain 22 carries an entrainment element 27 that projects radially outward from the respective conveyor chain 22, with the elements 27 aligned parallel to the drive shaft 25. The length of each entrainment element 27 is equal to about two to three times the height of the U-section rail 26.

The entire veneer machine including the means for knocking the flitch scrap off and the device for automatically transporting away are connected to a central controller, e.g. an SPS (memory programmed controller) or a processor that controls the operation of the veneer machine.

In use, which with the exception of knocking off the flitch 16 after the veneer-cutting operations is over and automatically carrying off the knocked-off flitch 16 corresponds to the state of the art, the tool slide 2 is retracted to the maximum spacing from the stay-log beam 4, into the so-called rest position. A flitch 16 is secured by means of the dogs 17 and claws 19 to the log bar 12. The tool slide 2 is advanced into a work position so that there is a tiny horizontal gap between the orbit of the outermost portion of the flitch 16 and the cutting edge of the blade 10. The drive for the log bar 12 is then turned on so that it rotates together with the clamped flitch about its longitudinal axis counterclockwise as shown by arrow 28 in FIG. 1. This way the portion of the flitch 16 closer to the tool slide 2 is moving upward. Once the nominal rotation speed is reached, the tool slide 2 is shifted inward toward the flitch 16 so that a veneer of the desired thickness is sliced off during the upward movement.

The cut-off veneer slices are carried off automatically.

Once the log bar 12 has reached a position in which the support face 15 is directed upward, the tool slide 2 is indexed inward toward the stay-long beam 4, the displacement being equal to the desired thickness of the veneer. This step is repeated until so many veneer slices have ben cut off the flitch 16 that only a minimal scrap part of the flitch 16 is left, one that cannot be cut because the blade 10 would engage the log beam. The veneer slicing machine is stopped automatically.

During the slicing, that is without interrupting the process, if necessary first the holding claws 19 are displaced back into their rest positions before the cutting edge of the blade 10 gets near them so that it cannot contact the retaining claws 19.

In order to remove the scrap part of the flitch 16 (scrap), the log bar 12 is moved into the six-o'clock position, that is with the flitch is directly underneath the axis of the log bar 12. The retaining claws 17 are opened. Then the pistons 21 are extended so as to knock the flitch 16 off the face 15. The flitch 16 falls down onto the planar and horizontal surface of the base frame 1 and lies there. Then the log bar 12 is moved into the twelve-o'clock position, that is with the face 15 directly above the axis of the log bar 12.

During these steps the tool slide 2 is pulled back. A new flitch 16 is fitted in place by the service personnel and the veneer-cutting operation starts over again. During the cutting operation the controller automatically starts up the conveyor chains 22. The entrainment elements 27 engage the flitch 16 and transport it away from the veneer machine. for example to another conveyor.

In this embodiment the shortest possible transport path for the conveyor chains 22 that is necessary for safe transport away of the flitch scrap has been shown. According to actual site conditions, it might be advisable to extend the transport path past the end of the frame 1 to a further conveyor.

The means for knocking off the flitch 16 can, alternatively to the hydraulically driven pistons 21, be magnetic or pneumatic bumpers or rockers. A rocker is a link assembly that is basically parallelogrammatic with one long side pivoted so that shifting of the short sides parallel to themselves moves out the long side.

The device for automatically transporting away can alternatively to the illustrated embodiment have at least one hydraulic cylinder effective in the plane of the frame 1 perpendicular to the longitudinal axis of the log beam and whose outer piston end carries a slide. Alternately it can be at least one roller array that either is driven or that is inclined downward in the desired transport direction.

REFERENCE NUMERAL LIST stationary frame 1
tool slide 2
blade holder 3
stay-log beam 4
arrow 5
rails 6
guides 7
machine frame 8
arrow 9
blade 10
pusher bar 11
log bar 12
housing 13
hydraulic cylinders 14
support face 15
flitch 16
retaining dogs 17
grooves 18
holding claws 19
first shafts 20
pistons 21
conveyor chains 22
motor 23
sprocket wheels 24
drive shaft 25
U-section rail 26
entrainment element 27

The invention claimed is:

1. A veneer-slicing machine comprising:

a frame;

a log beam extending along and rotatable on the frame about an axis and having a generally planar and longitudinally extending support face;

means for securing an elongated flitch to the support face;

a blade on the frame having a cutting edge extending substantially parallel to the axis and displaceable on the frame transversely of the axis, whereby, when the log beam is rotated to orbit the flitch about the axis and the blade is displaced into the orbit of the flitch, the blade slices veneer from the flitch;

means on the beam for, when the securing means has released the flitch, knocking the flitch off the face; and means adjacent the beam for transporting away a flitch knocked off the face.

2. The veneer-slicing machine defined in claim 1 wherein the means for knocking off the flitch includes at least one element displaceable on the beam between a retracted position recessed in the beam behind the face thereof and an extended position projecting outward through and past the face thereof.

3. The veneer-slicing machine defined in claim 2 wherein the beam is formed on the face with a throughgoing hole and the element is shiftable through the hole.

4. The veneer-slicing machine defined in claim 3 wherein the element is displaceable substantially perpendicular to the face.

5. The veneer-slicing machine defined in claim 4 wherein the beam is formed with a plurality of the holes spaced along the axis and the knockoff means includes respective such elements displaceable through the holes.

6. The veneer-slicing machine defined in claim 1 wherein the transport means includes at least two chains extending crosswise of the axis and drive means for transversely displacing the chains.

7. The veneer-slicing machine defined in claim 6 wherein the chains are underneath the beam on the frame.

8. The veneer-slicing machine defined in claim 7 wherein the chains have upper stretches recessed in the frame and provided with entrainment elements projecting upward past the frame.

* * * * *